United States Patent [19]

Kaplan et al.

[11] Patent Number: 4,797,681

[45] Date of Patent: Jan. 10, 1989

[54] DUAL-MODE CIRCULAR-POLARIZATION HORN

[75] Inventors: Sidney Kaplan, Los Angeles; Mon N. Wong, Torrance, both of Calif.

[73] Assignee: Hughes Aircraft Company, Los Angeles, Calif.

[21] Appl. No.: 871,194

[22] Filed: Jun. 5, 1986

[51] Int. Cl.[4] ..... H01Q 13/02; H01P 1/161

[52] U.S. Cl. ..... 343/786; 333/21 A; 333/137

[58] Field of Search ..... 343/756, 786; 333/21 A, 333/21 R, 137, 12, 135

[56] References Cited

U.S. PATENT DOCUMENTS

| | | | |
|---|---|---|---|
| 2,682,610 | 6/1954 | King | 343/786 |
| 2,961,618 | 11/1960 | Ohm | 333/137 |
| 3,162,828 | 12/1964 | Schmidt et al. | 333/137 |
| 3,924,205 | 12/1975 | Hansen et al. | 333/21 A |
| 4,162,463 | 7/1979 | Di Tullio et al. | 333/21 A |

FOREIGN PATENT DOCUMENTS

| | | | |
|---|---|---|---|
| 150950 | 11/1979 | Japan | 343/786 |
| 1219872 | 1/1971 | United Kingdom | 343/786 |

*Primary Examiner*—William L. Sikes

*Assistant Examiner*—Michael C. Wimer

*Attorney, Agent, or Firm*—S. M. Mitchell; M. J. Meltzer; A. W. Karambelas

[57] ABSTRACT

A dual mode circularly polarized horn radiator is useful in the testing of radiation apparatus in an anechoic chamber. The horn has a buffered radiating aperture which permits a plurality of the horns to be arranged in an array with minimal mutual coupling between the horns. The radiating aperture is located at an end of a conic section, of low flare angle, and has a diameter of one free-space wavelength of the radiation to be radiated from or received at the horn. This permits use of the horn for measurement of near field radiation pattern of apparatus under test. The horn includes an orthomode tee having mutually perpendicular rectangular waveguides extending therefrom, and being coupled thereby to a circular port. A polarizer connects the circular port of the tee to the conic section, and includes two sets of diametrically opposed pins for conversion of both right-hand and left-hand circular polarizations to linearly polarized radiation. A multiple-vaned structure at the tee and the ports thereof isolates the two linearly polarized waves to their respective rectangular waveguide ports.

13 Claims, 2 Drawing Sheets

DUAL-MODE CIRCULAR-POLARIZATION HORN

BACKGROUND OF THE INVENTION

This invention relates to horn type radiators for measurement of the near-field radiation patterns of electromagmetic radiation apparatus and, more particularly, to a horn having a polarizer and an orthomode tee for conversion between circularly polarized radiation of both senses and corresponding linearly polarized waves, the tee including a multiple blade type structure for isolating the linearly polarized waves.

The testing of radiation apparatus, such as various forms of radiators and array antennas, is important to insure that such an apparatus produces a desired radiation pattern and/or responds in a desired fashion to incident radiation. One form of testing of the radiation apparatus involves the measurement of the near-field radiation response in an anechoic chamber. Such testing may include the use of circularly polarized radiation with both right and left-handed polarizations being employed. Also, it is desirable to employ a radiator of the test equipment which is sufficiently unobtrusive, in a radiation sense, so as to avoid introduction of any perturbations to the radiation pattern being measured. It is also desirable that the radiation characteristics of the radiator employed for performing the test should have a uniform radiation pattern as measured in directions off of a central axis of symmetry of the radiation pattern.

A problem arises in that previously available probes for RF (radio frequency) radiation which are to be used for near-field radiation measurements have not met all of the foregoing requirements to the extent which would be desirable. Typically, such probes have employed a coaxial dipole or an open-ended waveguide for linear polarization, and a cross-dipole or a helix for circular polarization. In particular, it is noted that the electrical performances of the previously available probes are not able to meet the requirements of current state-of-the-art near-field computerized antenna range pattern measurements.

SUMMARY OF THE INVENTION

The foregoing problem is overcome and other advantages are provided by a dual-mode circular-polarization horn constructed in accordance with the invention, the horn including a buffer radiation aperture for more uniform transmission and reception of radiation in directions off of a central axis of symmetry. The radiation aperture has a diameter of one free-space wavelength of the radiation, thereby to permit near-field measurements without any significant intrusion into the radiation pattern being measured. The radiating aperture is circular, and connects via a conic section of small flare angle to a cylindrically-shaped polarizer and an orthomode tee, all of which support circular polarizations of both hands.

The orthomode tee has a circular port for transmission and reception of circularly polarized waves, and also includes a pair of orthogonally positioned, rectangular waveguide ports, each of which supports a linearly polarized electromagnetic wave associated with only one sense of circular polarization. In a preferred embodiment of the invention, one of the rectangular ports exits the tee from a back side thereof along a central axis thereof, and couples only to right-handed circularly polarized waves. A second of the rectangular ports exits from a side of the tee and couples only with a left-handed circularly polarized wave. A blade is disposed within a cylindrical housing of the tee parallel to a long wall of the back waveguide port, and perpendicular to an axis of the other rectangular port, to isolate the two ports and to act in the transition between linear and circular polarization. Additional mode isolation is provided in the waveguide of the side port by the use of two coplanar blades arranged serially along the axis of the side-port waveguide, the pair of blades inhibiting further any cross-coupling between the two rectangular waveguide ports. Thereby, the horn of the invention is readily employed as a test probe for both reception and illumination of radiation, the horn providing for the separation of waves having perpendicular linear polarizations so as to identify each of the linear polarizations with specific directions of rotation of the circular polarization.

BRIEF DESCRIPTION OF THE DRAWING

The foregoing aspects and other features of the invention are explained in the following description, taken in connection with the accompanying drawing wherein.

DETAILED DESCRIPTION

Figures 1, 2, 3:
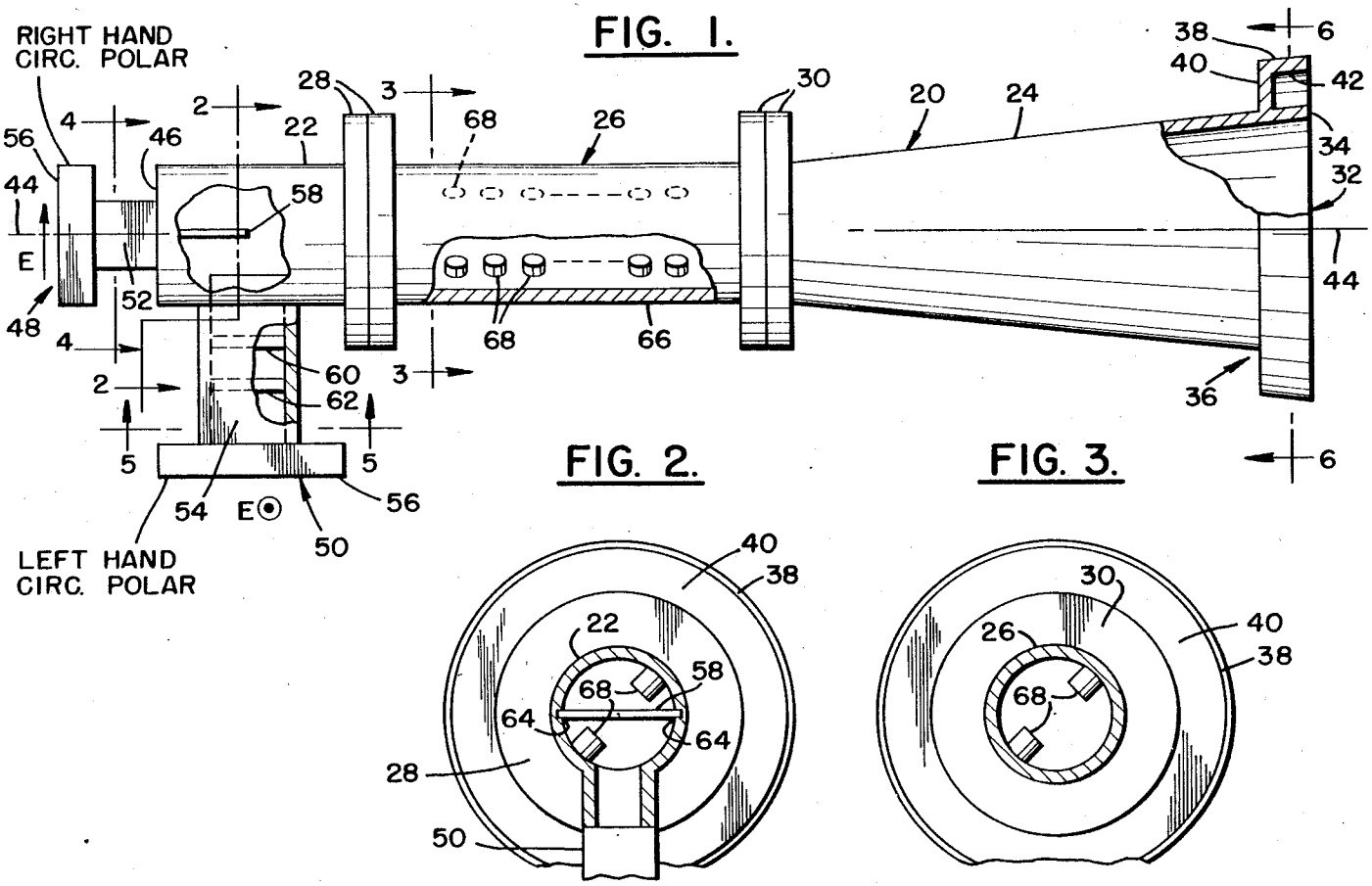
FIG. 1 is a side elevation view, of the dual-mode horn of the invention, the view being partially cut away to show further details of a radiating aperture and a mode separation and isolation structure.
FIG. 2 is a transverse section of the horn taken along the line 2—2 in FIG. 1.
FIG. 3 is a transverse section of the horn taken along the line 3—3 in FIG. 1.
Figure 4:
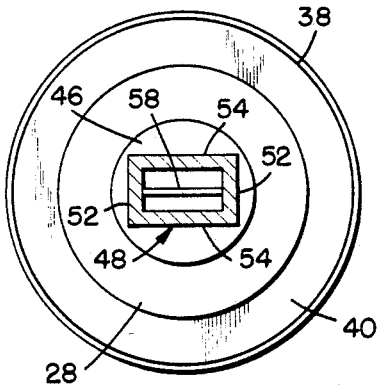
FIG. 4 is a transverse section of the horn taken along the line 4—4 in FIG. 1.

With reference to FIG. 1–6, there is shown a horn 20 constructed in accordance with the invention for the transmission and reception of circularly polarized radiation, and for the reception and transmission of two different linearly polarized waves, each of which is associated with a different direction of the circular polarization. The horn 20 comprises an orthomode tee 22 and a conic section 24 which are coupled together by a polarizer 26. The tee 22 and the polarizer 26 have circular cross section and are coupled together by flanges 28. The conic section 24 is also constructed with circular cross section and is coupled to the polarizer 26 by flanges 30. At the front end of the horn 20, the conic section 24 opens into a radiating aperture 32 located at a rim 34 of the conic section 24.

In accordance with a feature of the invention, the radiating aperture 32 is buffered by an outer ring assembly 36 comprising a ring 38 coaxial to the rim 34 and connected to the outer surface of the section 24 at a location between the rim 34 by a torroidal disk 40. Between the ring 38 and the outer surface of the section 24 there is formed a channel 42 which is open at the front and closed off at the back by the disk 40, the channel 42 having a width, as measured between the rim 34 and the ring 38, and a depth, as measured between the rim 34 and the disk 40, each of which is equal to one-quarter of the free-space wavelength of radiation to be transmitted and received by the horn 20. The outer ring assembly 36 provides a choking action to radiation in a direction along the axis of the conic section as well in directions perpendicular to the axis of the conic section. It also serves to reflect back, from the disk 40, an open circuit which appears at the radiating aperture 32. The diameter of the rim 34 is equal to one wavelength of the free-space radiation. The tee 22, the conic section 24 and the polarizer 26 are all mounted coaxially about a common longitudinal axis 44 of the horn 20.

In the case of the preferred embodiment of the invention, the radiation is at Ku band and has a wavelength of approximately one inch. The inner surface of the conic section 24 extends from a minimum diameter at the flanges 30 of ¾ inch to a maximum diameter at the rim 34 of one inch. The length of the conic section 24, as measured between the rim 34 and the flange 30 of the section 24, is approximately four inches. Thus, the ratio of change in diameter to length along the axis 44 in the conic section 24 is approximately 1:16. This ratio characterizes the conic section 24 as having a small flare angle. The small flare angle is advantageous for coupling radiation between the reduced diameter of the polarizer 26 and space in front of the horn 20; this coupling is accomplished efficiently and with good radiation pattern, and without introducing any significant deleterious reflections in the transition in size between the reduced diameter at the flanges 30 and the increased diameter at the rim 34.

The tee 22 has an outer cylindrical housing which terminates in a wall 46 at the back end of the horn 20. Two rectangular waveguide ports are provided on the tee 22, these two ports being a back port 48 extending outwardly from the wall 46, and a side port 50 extending outwardly from the cylindrical side wall of the tee 22. Each of the ports 48 and 50 is formed of a rectangular waveguide having short walls 52 and long walls 54. In a preferred emboidment of the invention, the ratio of the width of the long wall to the short wall is 2:1. In the waveguides of each of the ports 48 and 50, the electric field of a linearly polarized electromagnetic wave propagating through the waveguide is perpendicular to the long walls of the waveguide. As shown in FIG. 1, the waveguides of the ports 48 and 50 are oriented such that their respective longitudinal axes are perpendicular to each other, and that a long wall 54 of the port 50 lies in a plane which is parallel to a plane of the short wall 52 of the port 48. The electric field vector at the port 48 lies in a plane parallel to the sheet of the drawing, and the electric field of the port 50 lies perpendicularly to the plane of the sheet of the drawing. The waveguides of both of the ports 48 and 50 support a $TE_{10}$ mode of propagation. The outer end of the walls 52 and 54 terminate in flanges 56 which enable coupling of the ports 48 and 50 to external circuitry as will be shown in FIG. 7.

Figure 5:
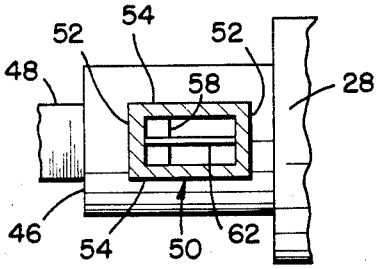
FIG. 5 is a section taken along the line 5—5 in FIG. 1.

In accordance with a further feature of the invention, separation and isolation of the linearly polarized waves of the ports 48 and 50 is accomplished by means of a multiple blade structure composed of a single vane or blade 58 located within the cylindrical housing of the tee 22, and a pair of coplanar vanes or blades 60 and 62 located within the waveguide of the side port 50. The blade 58 has a planar form, lies along the central axis 44 of the horn 20, is parallel to the plane of a long wall 54 of the back port 48, and extends forward of the back wall 46 to a location approximately one-third of the distance between the short walls 52 of the side port 50. The forward edge of the blade 58 is visible in a view along the axis of the side port 50 as shown in FIG. 5. Preferably, the blade 58 is supported within slots 64 within the cylindrical side walls of the tee 22 (FIG. 2) to allow for positioning of the blade 58 along the axis 44, thereby to optimize coupling and isolation of electromagnetic waves of the ports 48 and 50. The length of the blade 58, as measured along the axis 44, is approximately one-half of the guide wavelength of the radiation propagating through the tee 22.

The two blades 60 and 62 each have a planar shape and are parallel to the long walls 54 of the side port 50, the blades 60 and 62 extending from one of the short walls 52 to the other of the short walls 52 in the port 50, and being disposed midway between the two long walls 54. Each of the vanes 60 and 62 has a width, as measured along an axis of the waveguide of the side port 50, of one-tenth of the guide wavelength. The two blades 60 and 62 are spaced apart, as measured between centers of the blades, by a distance of one-quarter of the guide wavelength. The depths of each of the blades 58, 60 and 62 is less than approximately a few per cent of the guide wavelength.

In the operation of the blades 58, 60, and 62 to separate and to isolate the waves of the ports 48 and 50, the electric field of the back port 48 is perpendicular to the blade 58, and therefore, the blade 58 is transparent to an electromagnetic signal passing through the back port 48. In contradistinction, the electric field of the wave passing through the side port 50 is parallel to the blade 58, and, therefore, the blade 58 rejects the electromagnetic signal of the side port 50 and prevents this signal from propagating through the back port 48. Similarly, the two blades 60 and 62 are perpendicular to the electric field in the side port 50 and, therefore, are transparent to the propagation of the electromagnetic signal in the port 50. However, the blades 60 and 62 are parallel to the electric field of the back port 48, and, accordingly, reject the electric field of the electromagnetic signal in the port 48 so as to prevent the electromagnetic signal of the port 48 from entering the side port 50.

The extent of the protrusion of the leading edge of the blade 58 over a portion of the side port 50 aids in the direction of the electromagnetic signal of the side pot 50 to couple electromagnetic energy between the side port 50 and the circular port at the front of the tee 22.

The polarizer 26 comprises a cylindrical wall 66 extending between the flanges 28 and 30 for a distance of approximately three guide wavelengths, the distance being 4 inches in a preferred embodiment of the invention. Pins 68 extend inwardly from the wall 66 toward the central axis 44. The pins 68 are arranged in two rows on opposite sides of a diametrical plane passing through the axis 44. In each row of the pins 68, the row extends a distance of 2½ guide wavelengths along the axis 44, and there are 11 pins spaced apart on centers from each other with a spacing of one-eighth guide wavelength. The aforementioned diametrical plane (not shown) is inclined at an angle of 45 degrees relative to the plane of the blade 58.

The operation of the polarizer 26, and also the operations of the tee 22 and the conic section 24 are reciprocal so as to interact with an outgoing transmitted electromagnetic wave in the same fashion as with an incoming received electromagnetic wave. An outgoing electromagnetic wave views the array of pins 68 as shown in FIGS. 2 and 3 wherein the plane of the pins 68 is rotated 45 degrees in the counter clockwise direction.

Figure 6:
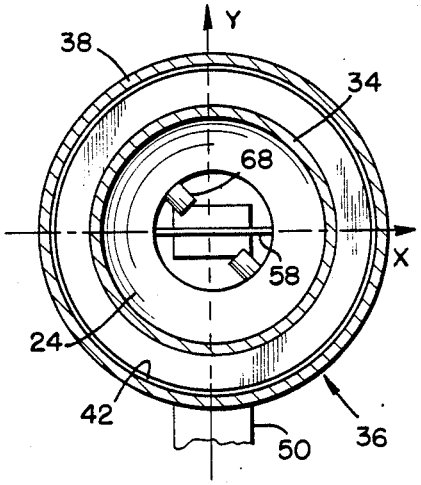
FIG. 6 is a section of the horn taken along the line 6—6 in FIG. 1.

An incoming electromagnetic wave views the array of pins 68, as shown in FIG. 6, wherein the plane of the pins 68 has been rotated in the clockwise direction from the plane of the blade 58. For convenience, an x-y coordinate system is shown in FIG. 6 superposed upon the ring assembly 36 with the x axis parallel to the plane of the blade 58, and the y axis parallel to an axis of the side port 50.

The inclination of the plane of the pins 68 allows the pins 68 to interact with a wave having an electric field parallel to the y axis and with a wave having the electric field parallel to the x axis. With respect to the wave propagating through the back port 48, the electric field vector is parallel to the y axis. With respect to a wave propagating through the side port 50, the path of propagation is bent at a right angle at the tee 22 maintaining the direction of the electric field vector parallel to the x axis. The pins 68 interact with a TE (transverse electric) wave, whether the electric vector be parallel to the y axis of the x axis, by splitting the TE wave into an x component and a y component, and by introducing a 90 degree phase shift between the x component and the y component of the TE wave. This operation converts a linearly polarized wave to a circularly polarized wave.

By virtue of the spacing between pins 68 of only one-eighth guide wavelength, rather than the customary one-quarter guide wavelength, the array of pins 68 can interact with linearly polarized electromagnetic waves to generate both left-hand and right-hand circularly polarized waves. The specific geometrical relationship between the back port 48, the side port 50, and the inclination of the plane of the pins 68 results in the conversion of the linearly polarized waves at the back and the side ports 48 and 50, respectively to right-hand and left-hand circularly polarized waves, respectively. Due to the reciprocal operation of the components of the horn 20, an incoming circularly polarized wave of the right-hand sense is converted to a linearly polarized wave exiting the back port 48, and an incoming circularly polarized wave of the left-hand sense is converted to a linearly polarized wave exiting the side port 50.

In a preferred embodiment of the invention, the overall length of the horn 20 is approximately 12 inches. The waveguide used in the construction of the ports 48 and 50 is size WR-75. In experimental tests of the horn 20, a spinning linear radiation pattern has been measured; the pattern shows an axial ratio over a plus and minus 20 degree angular region which is less than 0.2 dB (decibels). Thus, the intensity of radiation, both for right-hand and left-hand circular polarization is substantially uniform as measured off axis in both the x and the y directions in the coordinate system of FIG. 6. The measurements are made in front of the horn 20, and show a radiation pattern which is symmetrical about the axis 44. In an experimental model of the invention, the inside diameter of the rim 34 measures 1.06 inches, the inside diameter of the ring 38 measures 1.77 inches, the depth of the channel 42 measures 0.33 inch, and the thickness of the wall of the conic section 24 as well as the wall 66 of the polarizer 26 measures 0.045. All of the above-described components of the horn 20 are constructed of electrically conducting material such as brass or aluminum.

Figure 7:
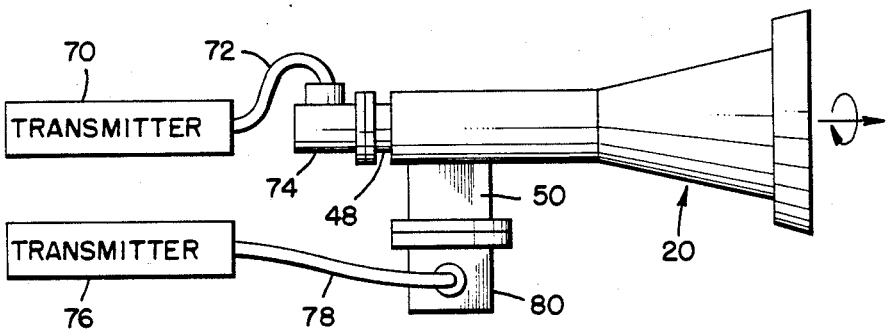
FIG. 7 is a partially diagrammatic view showing use of the horn with a pair of transmitters.

FIG. 7 shows the use of the horn 20 as an illuminator of electromagnetic energy. A first transmitter 70 connects via a coaxial cable 72 to a coax-to-waveguide adapter 74 secured to the back port 48. The second transmitter 76 is connected via a coaxial cable 78 to a coax-to-waveguide adapter 80 which is secured to the sideport 50. Signals transmited by the transmitter 70 exit the horn 20 as right-hand circularly polarized waves. Signals transmitted by the transmitter 76 exit the horn 20 as left-hand circularly polarized waves. The two transmitters 70 and 76 operate independently of each other, and the two outgoing circularly polarized waves are generated completely independently of each other.

In view of the reciprocal operation of the horn 20, the two transmitters can be replaced by receivers (not shown) for receiving circularly polarized microwave radiation incident upon the radiating aperture of the horn 20. Also, if desired, a transmitter can be coupled to one of the ports 48 and 50 and a receiver coupled to the other of the ports 48 and 50 for combined operation of the horn 20 for both illumination and reception of the microwave electromagnetic energy. The relatively small radiating aperture of the horn 20, approximately one wavelength, permits the horn 20 to be used in the measurement of the near field of radiating antennas and other microwave apparatus without introducing any significant perturbation to the field being measured.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A dual mode circularly polarized horn radiator comprising:

an orthomode tee having a circular cylindrical shape extending along a central axis thereof; said tee including a circular port at a front end of the tee, a back port of rectangular configuration extending outward of a back end of said tee opposite said circular port, and a side port of rectangular configuration extending outward of a cylindrical wall of said tee; each of said back and said side ports having a pair of short walls and a pair of long walls; a plane of each long wall of said side port being parallel to a plane of each short wall of said back port, each of said back and said side ports supporting a linearly polarized electromagnetic wave, a wave of said back port being polarized perpendicularly to a wave of said side port;

a conic section extending along a direction of radiation propagation and supporting circularly polarized electromagnetic waves, said conic section having a central axis, a front port and a back port smaller than said front port, said front port serving as a radiating aperture of said horn, a rim of said front port having a diameter equal to approximately one free-space wavelength;

a polarizer of cylindrical configuration connecting the circular port of said tee with the back pot of said conic section, said polarizer providing a conversion between a linearly polarized wave in said tee and a circularly polarized wave in said conic section;

isolation means comprising a single planar blade in said tee and a pair of coplanar blades in said side port of said tee, a plane of said single blade and a plane of said paired blades being perpendicular to each other and intersecting along said central axis of said tee, said isolation means improving isolation between linearly polarized waves in said side port and said back port of said tee to permit independent operation of said polarizer to the linearly polarized waves, there being a conversion between circular polarization of one hand and a linearly polarized wave of said back port of said tee and a conversion between circular polarization of the opposite hand and a linearly polarized wave of said side port; and buffer means disposed concentrically around said radiating aperture for modifying a distribution of current in said radiating aperture; said buffer means comprising a ring spaced apart from said rim of said front port of said conic section, and a torrodial wall disposed behind said rim for shorting said rim to a sidewall of said conic section; said buffer means improving uniformity of radiation by said radiating aperture in directions off an axis of said conic section.

2. A radiator according to claim 1 wherein said back port of said tee includes a section of rectangular waveguide supporting a wave with electric field perpendicular to the long wall, said side port includes a section of rectangular waveguide supporting a wave with an electric field perpendicular to the long wall thereof, said single blade of said isolation means lying in a plane parallel to the plane of a long wall of said back port of said tee and extending from said back port to a location approximately one-third of the distance between the short walls of said side port.

3. A radiator according to claim 2 wherein said paired blades of said isolation means are constructed each with a width of approximately one-tenth of the guide-wavelength as measured along an axis of the waveguide of said side port, and wherein the pair of blades are spaced apart by approximately one-quarter of the guide-wavelength as measured on centers of the paired blades, each of the paired blades extending from one short wall to the other short wall of the waveguide of said side port of said tee.

4. A radiator according to claim 1 wherein said buffer means reflects back, from said torroidal wall towards said rim, an open circuit which appears at said radiation aperture.

5. A radiator according to claim 4 wherein, in said buffer means, said ring is spaced apart by one-quarter of the free-space radiation wavelength from said rim, and said torroidal wall is displaced one-quarer of the free-space radiation wavelength behind said rim to provide for a choking action to radiation in a direction along the axis of the conic section as well as in directions perpendicular to the axis of the conic section.

6. A radiator according to claim 1 wherein said polarizer comprises two sets of pins, which sets of pins are located along an interior cylindrical wall of the polarizer parallel to a central axis thereof and at opposite edges of a diametrical plane, each of said sets extending a distance of approximately 2½ guide-wavelengths of the radiation, individual ones of the pins being spaced apart on centers by one-eighth of the radiation guide wavelength, said diametrical plane being inclined at an angle of 45 degrees relative to said long wall of said back port to provide for conversion between both right and left-hand circular polarizations and their corresponding linearly polarized waves.

7. A radiator according to claim 6 wherein said back port of said tee includes a section of rectangular waveguide supporting a wave with electric field perpendicular to the long wall, said side port includes a section of rectangular waveguide supporting a wave with an electric field perpendicular to the long wall thereof, said single blade of said isolation means lying in a plane parallel to the plane of a long wall of said back port of said tee and extending from said back port to a location approximately one-third of the distance between the short walls of said side port; and wherein said paired blades of said isolation means are constructed each with a width of approximately one-tenth of the guide-wavelength as measured along an axis of the waveguide of said side port, and wherein the pair of blades are spaced apart on centers by approximately one-quarter of the guide-wavelength as measured on centers of the paired blades, each of the paired blades extending from one short wall to the other short wall of the waveguide of said side port of said tee.

8. A radiator according to claim 7 wherein said buffer means reflects back, from said torroidal wall towards said rim, an open circuit which appears at said radiation aperture; and wherein in said buffer means, said ring is spaced apart by one-quarter of the free-space radiation wavelength from said rim, and said torroidal wall is displaced one-quarter of the free-space radiation wavelength behind said rim to provide for a choking action to radiation in a direction along the axis of the conic section as well as in directions perpendicular to the axis of the conic section.

9. A radiator according to claim 8 wherein said conic section has a small flare angle, the diameter of the conic section changing at a rate of one-quarter inch along an axial distance of approximately 4 inches.

10. A radiator according to claim 1 wherein said conic section has a small flare angle, the diameter of the conic section changing at a rate of one-quarter inch along an axial distance of approximately 4 inches.

11. A dual mode circularly polarized horn radiator comprising:

means, including a radiating aperture, for radiating circularly polarized electromagnetic radiation, said aperture having a diameter of approximately one free-space wavelength of the radiation. said means for radiating including means for buffering said radiating aperture to improve uniformity in a pattern of the radiation;

conversion means for providing a conversion between circularly polarized and linearly polarized radiation, said conversion means including a set of phase shift elements spaced apart by one-eighth the guide wavelength of the radiation for conversion between both clockwise and counterclockwise circularly polarized radiation and two orthogonal linearly polarized waves;

coupling means including a first port and a second port for propagation of respective ones of said linearly polarized waves, said coupling means coupling said linearly polarized waves individually between said conversion means and respective ones of said ports; and means within said coupling means for isolating said linearly polarized waves from each other, said isolating means including first and second planar blade structures oriented along axes of respective ones of said ports, said first blade structure comprising a single blade extending along a direction of radiation propagation in said coupling means a distance of one-half of the guide wavelength of the radiation and said second blade structure comprising a pair of coplanar blades positioned along a plane perpendicular to a plane of said blade in said first blade structure, the blades of said second blade structure being of shorter dimension than the blade of said first blade structure, as measured along a direction of wave propagation.

12. A radiator according to claim 11 wherein said means for radiating includes a conic section extending along a direction of radiation propagation, said conic section having a front port and a back port smaller than said front port, said front port serving as said radiating aperture.

13. A radiator according to claim 12 wherein said conversion means is constructed as a polarizer of cylindrical configuration connecting a port of said coupling means with the back port of said conic section, said conversion means being pins, and said linearly polarized waves being transverse electric waves.

* * * * *